US007762305B2

(12) United States Patent
Huang

(10) Patent No.: US 7,762,305 B2
(45) Date of Patent: Jul. 27, 2010

(54) SLIDE RAIL STRUCTURE FOR A WINDOW BLIND

(76) Inventor: Yih-Ren Huang, No. 107, Meining St., Taishan Township, Taipei County 243 (TW)

( * ) Notice: Subject to any disclaimer, the term of this patent is extended or adjusted under 35 U.S.C. 154(b) by 612 days.

(21) Appl. No.: 11/592,241

(22) Filed: Nov. 3, 2006

(65) Prior Publication Data

US 2008/0105388 A1 May 8, 2008

(51) Int. Cl.
*E05D 15/06* (2006.01)

(52) U.S. Cl. ..... 160/201; 160/196.1; 160/202

(58) Field of Classification Search ..... 160/196.1, 160/197, 198, 199, 202, 204, 206, 211
See application file for complete search history.

(56) References Cited

U.S. PATENT DOCUMENTS 978,581 A * 12/1910 Hamilton ..... 104/106
2,715,966 A * 8/1955 Tieck ..... 211/94.01
3,054,447 A * 9/1962 Brydolf ..... 160/206
3,058,173 A * 10/1962 Brydolf ..... 49/411
3,090,424 A * 5/1963 Carlo ..... 160/23.1
3,348,603 A * 10/1967 Ford ..... 160/197
3,425,162 A * 2/1969 Halpern ..... 49/425
3,480,989 A * 12/1969 Edeus ..... 16/94 R
3,636,588 A * 1/1972 Ferris ..... 16/94 R
3,796,405 A * 3/1974 Rystad ..... 248/489
3,883,924 A * 5/1975 Grabman ..... 16/94 D
3,911,991 A * 10/1975 Malferrari ..... 160/202
3,974,777 A * 8/1976 Monne ..... 104/94
4,524,698 A * 6/1985 Tourtellier et al. ..... 104/107
4,742,645 A * 5/1988 Johnston ..... 49/372
4,785,485 A * 11/1988 Etesam ..... 4/557
4,887,394 A * 12/1989 Marlowe ..... 49/409
5,109,910 A * 5/1992 Tortorella et al. ..... 160/197
5,123,128 A * 6/1992 Hines ..... 4/557
5,598,666 A * 2/1997 Kurth ..... 49/409
5,669,518 A * 9/1997 Kundel ..... 212/315
5,915,442 A * 6/1999 Prosch ..... 160/84.01
6,003,583 A * 12/1999 Lacoste et al. ..... 160/122
6,039,516 A * 3/2000 Diels ..... 409/134
6,336,247 B1 * 1/2002 Schnoor ..... 16/87.6 R
6,381,904 B1 * 5/2002 Tedescucci ..... 49/409
6,499,408 B1 * 12/2002 Kundel, Sr. ..... 104/94
6,612,638 B1 * 9/2003 Fliege et al. ..... 296/138
D502,387 S * 3/2005 Hyakkoku ..... D8/354
6,860,064 B2 * 3/2005 Bakalar ..... 49/127

(Continued)

*Primary Examiner*—Katherine W Mitchell
*Assistant Examiner*—Jaime F Cardenas-Garcia
(74) *Attorney, Agent, or Firm*—Troxell Law Office, PLLC

(57) ABSTRACT

A slide rail structure for a window blind includes at least one extensible rail set, at least one pulley set, and a plurality of top brackets. The extensible rail set is provided with at least two slide rails which are loosely extended with respect to each other and are assembled together, and a side of each slide rail is provided with an open slot. The pulley set is loosely assembled in the slide rail of extensible rail set, and is extended out of the open slot at one side of each slide rail. A side of each top bracket is formed with an arc-shape locking part for sheathing the slide rail of extensible rail set, and a top of each top bracket is provided with a hole for locking and positioning. The slide rail structure can be easily and quickly assembled, can be rigidly positioned and can slide smoothly.

14 Claims, 9 Drawing Sheets

U.S. PATENT DOCUMENTS 6,892,783 B1 * 5/2005 Comeau et al. ..... 160/126
7,065,831 B2 * 6/2006 Elmer ..... 16/91
7,174,944 B1 * 2/2007 Clark et al. ..... 160/197
7,260,916 B2 * 8/2007 Sarnell et al. ..... 49/409
7,270,165 B1 * 9/2007 Chuang ..... 160/197
7,293,596 B2 * 11/2007 Nien ..... 160/89
7,299,852 B1 * 11/2007 Chuang et al. ..... 160/197
7,346,939 B2 * 3/2008 Perry ..... 4/557
2004/0020613 A1 * 2/2004 Koike ..... 160/196.1
2007/0158036 A1 * 7/2007 Lin ..... 160/197
2007/0261799 A1 * 11/2007 Chu ..... 160/197
2008/0128098 A1 * 6/2008 Colson et al. ..... 160/197

* cited by examiner

SLIDE RAIL STRUCTURE FOR A WINDOW BLIND

BACKGROUND OF THE INVENTION (a) Field of the Invention

The present invention relates to a slide rail structure for a window blind, and more particularly to a slide rail structure which is provided with at least one extensible rail set, at least one pulley set, and a plurality of top brackets to achieve effects of an easy and quick assembly, a stable positioning, a smooth sliding, and being delicate and pretty, thereby being applied to all kinds of slide rails for window blinds or similar structures.

(b) Description of the Prior Art

A conventional slide rail structure for a window blind includes primarily a plurality of rail sets which are installed on a top edge of a window. A lower edge of each rail set is provided respectively with a plurality of parallel sliding slots, for sheathing sliding rods which are used to suspend a body of window blind. In addition, a top edge of each of the aforementioned rail sets is provided with a plurality of locking slots, and a positioning set is constituted by positioning units which are fixed at two sides of the top edge of window to suspend the rail sets. The positioning unit further includes a positioning plate and a plurality of positioning blocks which are serially installed on the positioning plate, and a bottom end of the positioning block is provided with a locking part which is latched with the locking slot of rail set, so as to be associated with an implementation for suspending the body of a multi-layer window blind, by adjusting an amount of the locking part of positioning block and of the rail set. Although the slide rail structure for the window blind is provided with the function of suspending the body of multi-layer window blind, the rail is in a fixed design; therefore, a length of the entire structure is fixed, and the structure cannot be extended for use. Moreover, as there are too many locking positions in the entire structure, it will cause an inconvenience to implementation personnel while working on site, and thus waste a labor time. On the other hand, if the rail is configured as usual, into two slide rails which are assembled together and can be loosely extended with respect to each other, as a connection surface of the two rails is formed with a stage-like drop, a pulley which slides in the rail will not slide smoothly, or will be even jammed. Furthermore, an end side of each slide rail should be sheathed with a side cover to prevent the pulley from sliding out. Accordingly, the conventional rail structure still cannot meet a user's requirement in a practical application.

SUMMARY OF THE INVENTION

The primary object of present invention is to provide a slide rail structure for a window blind, wherein by a design which assembles at least one extensible rail set, at least one pulley set, and a plurality of top brackets, each top bracket can provide a quick and robust sheathing for two ends of slide rails of the extensible rail set by arc-shape locking parts formed at sides of the top brackets, so as to provide effects of an easy and quick assembly and a rigid positioning, thereby greatly improving a practicability and convenience of the entire structure.

Another object of the present invention is to provide a slide rail structure for a window blind, wherein by walls which are formed at end sides of the top brackets for providing an abutting and positioning for the slide rails of extensible rail set, cost and assembly time which were spent for manufacturing the top bracket and a side cover at a same time can be effectively reduced, and by an indentation part which is located above the wall at the end side of top bracket, strength of the top bracket can be improved, so as to provide effects of an easy assembly, a reduction of cost, and an increase of the strength of top bracket, thereby improving a practicability and convenience of the entire structure.

Still another object of the present invention is to provide a slide rail structure for a window blind, wherein by a hole which is located on each top bracket, the top brackets can be directly locked and positioned on a ceiling, or, the hole of each top bracket can be first locked and assembled with a plurality of holes on an auxiliary piece with screw elements, and then the auxiliary piece is assembled with a wall bracket by screw elements according to requirement, such that the top brackets can be locked and assembled on the wall or the ceiling. Therefore, each extensible rail set, pulley set, top bracket, and auxiliary piece can be assembled first, and then are quickly locked on the wall bracket by implementation personnel, thereby facilitating an on-site implementation and improving convenience of the entire structure.

Yet another object of the present invention is to provide a slide rail structure for a window blind, wherein by a long piece which is located between two opposite sliding blocks of the pullet set, and a loose assembling of a shaft on a bended extension section of the sliding block with a roller, each slide rail can smoothly slide in the extensible rail set, thereby improving a practicability of the entire structure.

Still yet another object of the present invention is to provide a slide rail structure for a window blind, wherein by a U-shape bending part which is formed on at least one side of the sliding block, and a projection part of a slope which is formed at a front end of a side wall of the sliding block, the long piece can be easily pushed in, and the sliding block can be easily locked and assembled with a through-hole of the long piece, thereby forming a rigid positioning. Moreover, as an open slot of each slide rail of the present invention is opened toward an interior, an entire appearance will be very delicate and pretty after being assembled, without exposing out the interior components, so as to increase the beauty. Therefore, the present invention is provided with effects of an easy and quick assembling, a rigid positioning, and being delicate and pretty, thereby increasing a practicability, a convenience, and a beauty of the entire structure.

Accordingly, a slide rail structure for a window blind of the present invention includes at least one extensible rail set, at least one pulley set, and a plurality of top brackets. The extensible rail set is provided with at least two slide rails which are loosely extended with respect to each other and are assembled together, and a side of each slide rail is opened with an open slot. The pulley set is loosely assembled in the slide rail of extensible rail set, and is extended out of the open slot at one side of the slide rail. The pulley set is also assembled with a long piece on which is fixed with an assembly element for assembling with and positioning a window blind. Each top bracket is assembled with the extensible rail set, and a side of each top bracket is formed with an arc-shape locking part, for sheathing the slide rail of extensible rail set (wherein an end side of the top bracket which is assembled at two ends of the extensible rail set can be further provided with a wall, for abutting and positioning the slide rail of extensible rail set), whereas each top bracket is provided with a hole for locking and positioning. Accordingly, the present invention is provided with effects of an easy and quick assembling, a rigid positioning, a smooth sliding, and being delicate and pretty.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
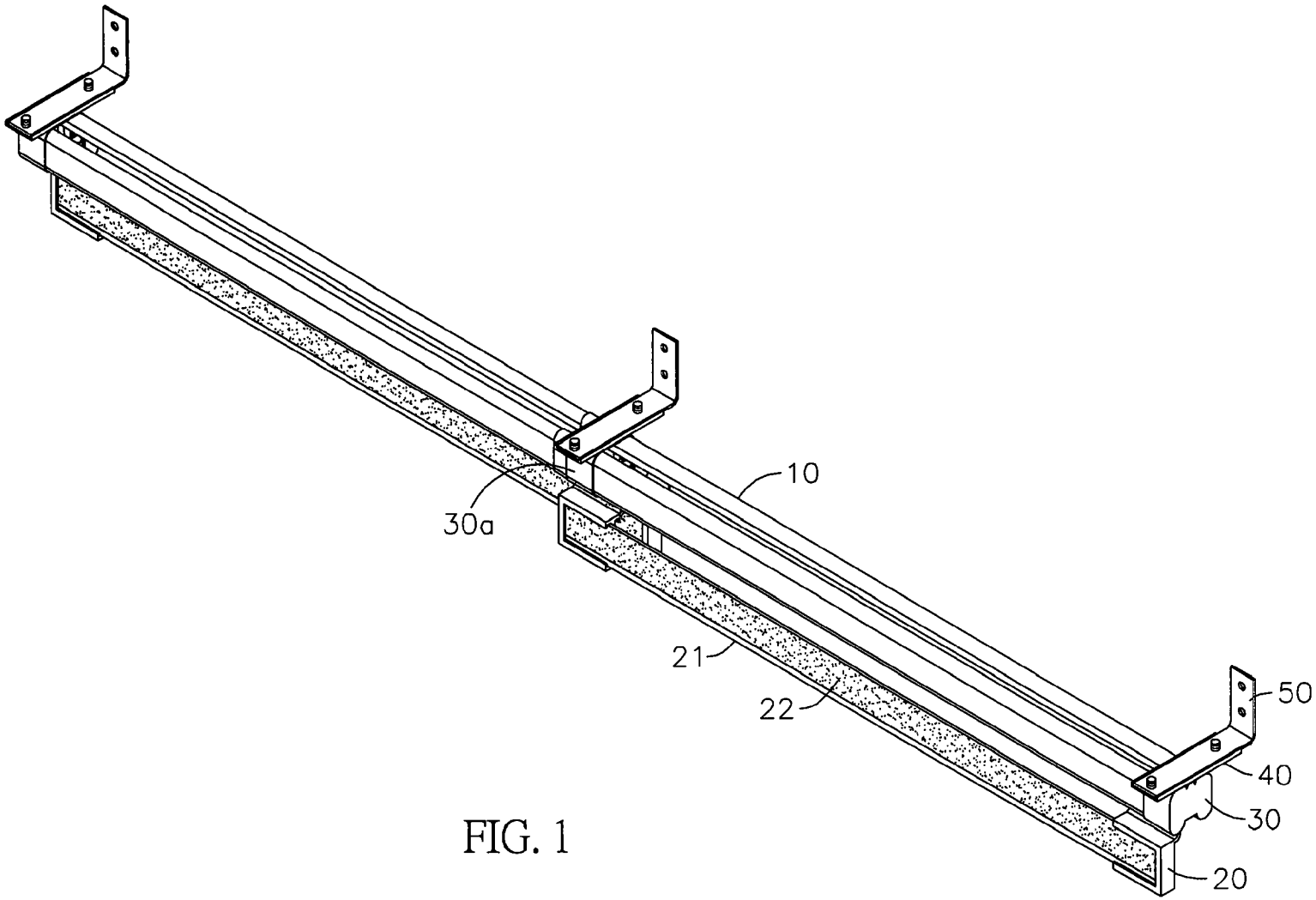
FIG. 1 shows a perspective view of a first embodiment of the present invention.
Figure 2:
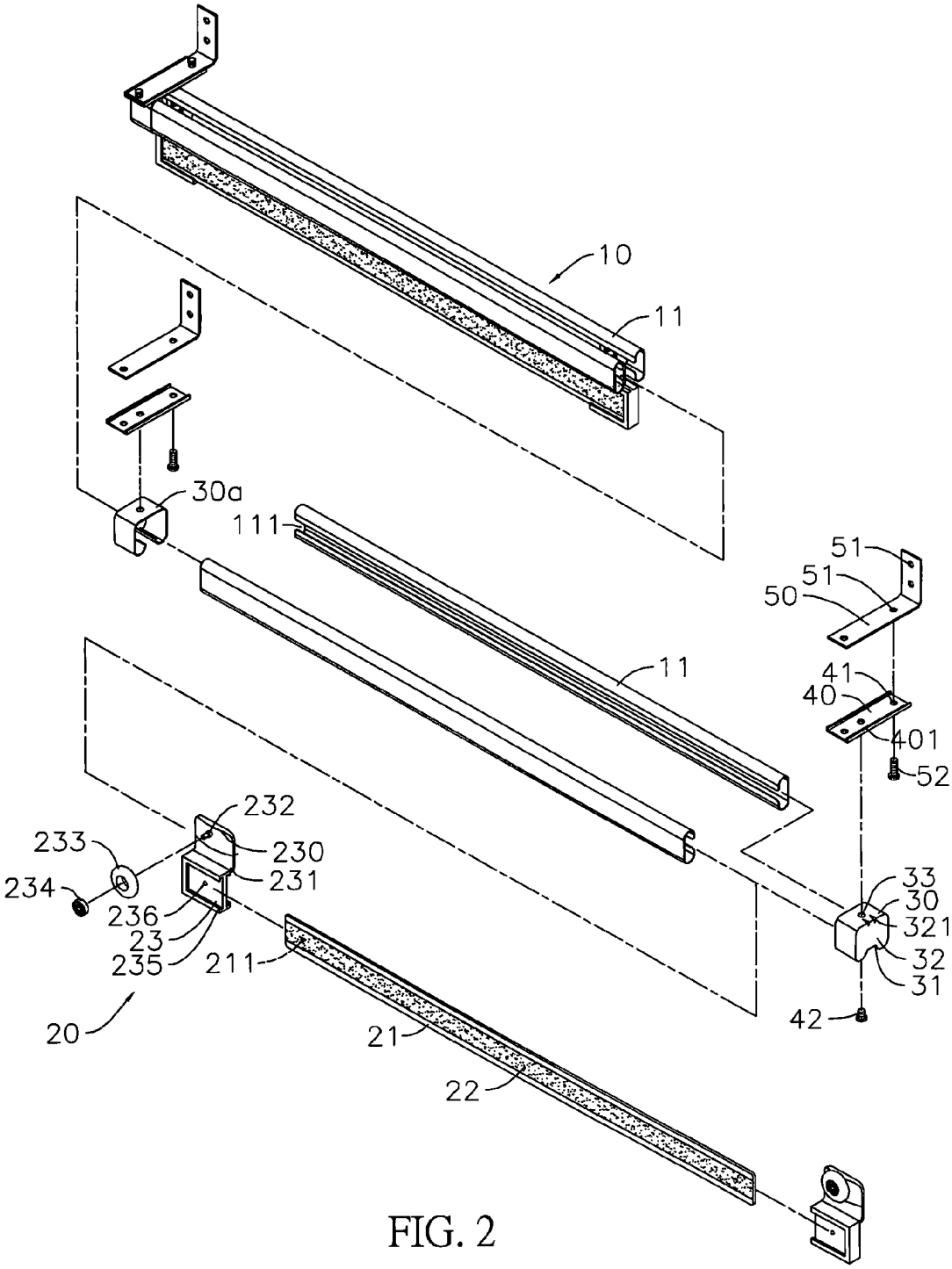
FIG. 2 shows an exploded view of a first embodiment of the present invention.
Figure 3:
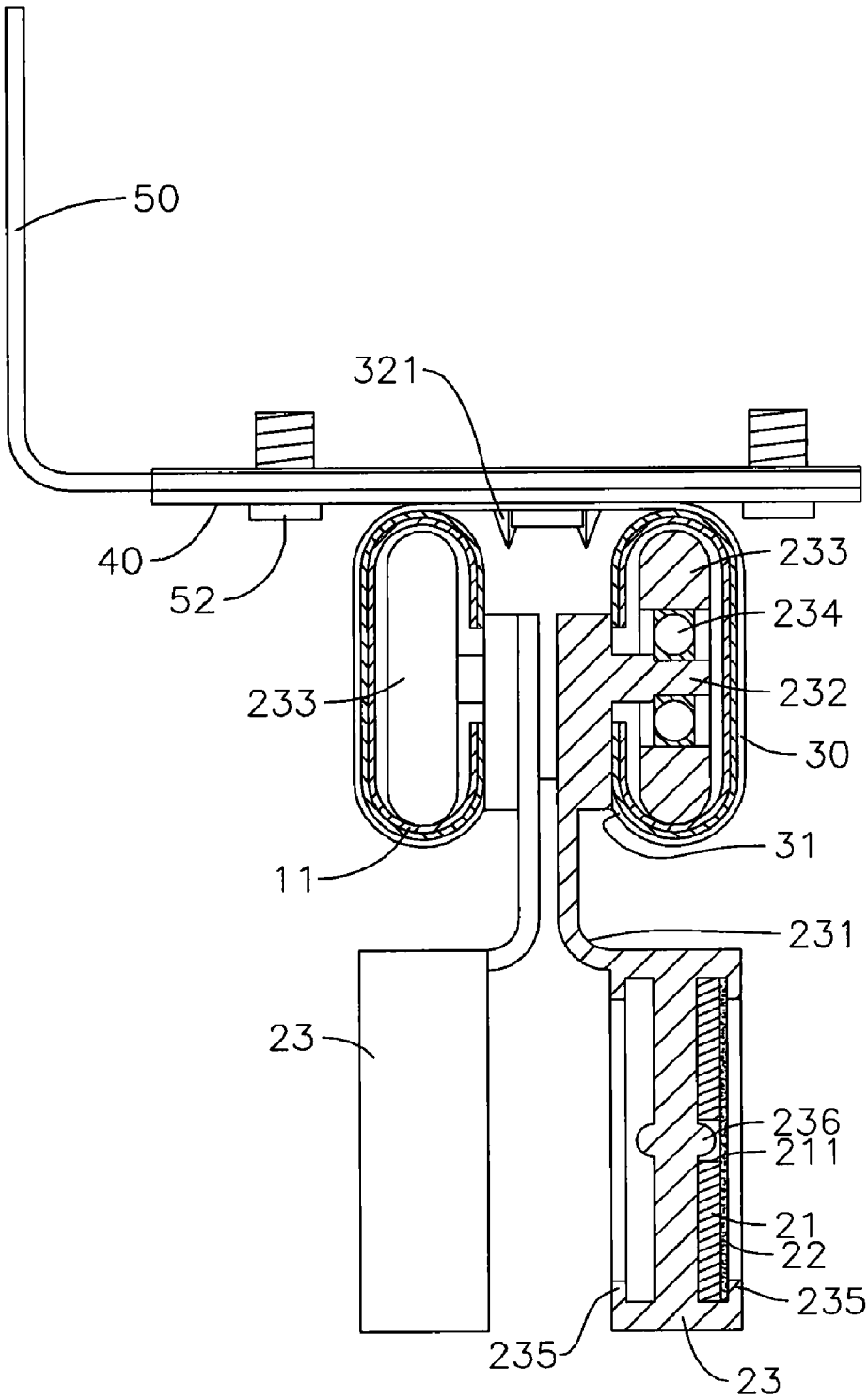
FIG. 3 shows a cutaway view of a first embodiment of the present invention.
Figure 4:
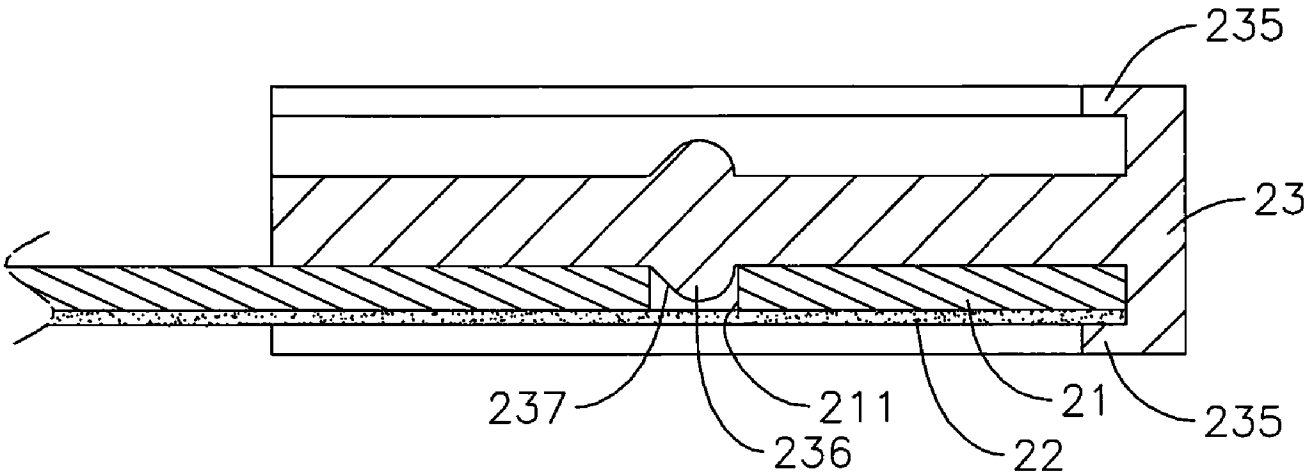
FIG. 4 shows a cutaway view of a sliding block being assembled with a long piece of a first embodiment of the present invention.
Figure 5:
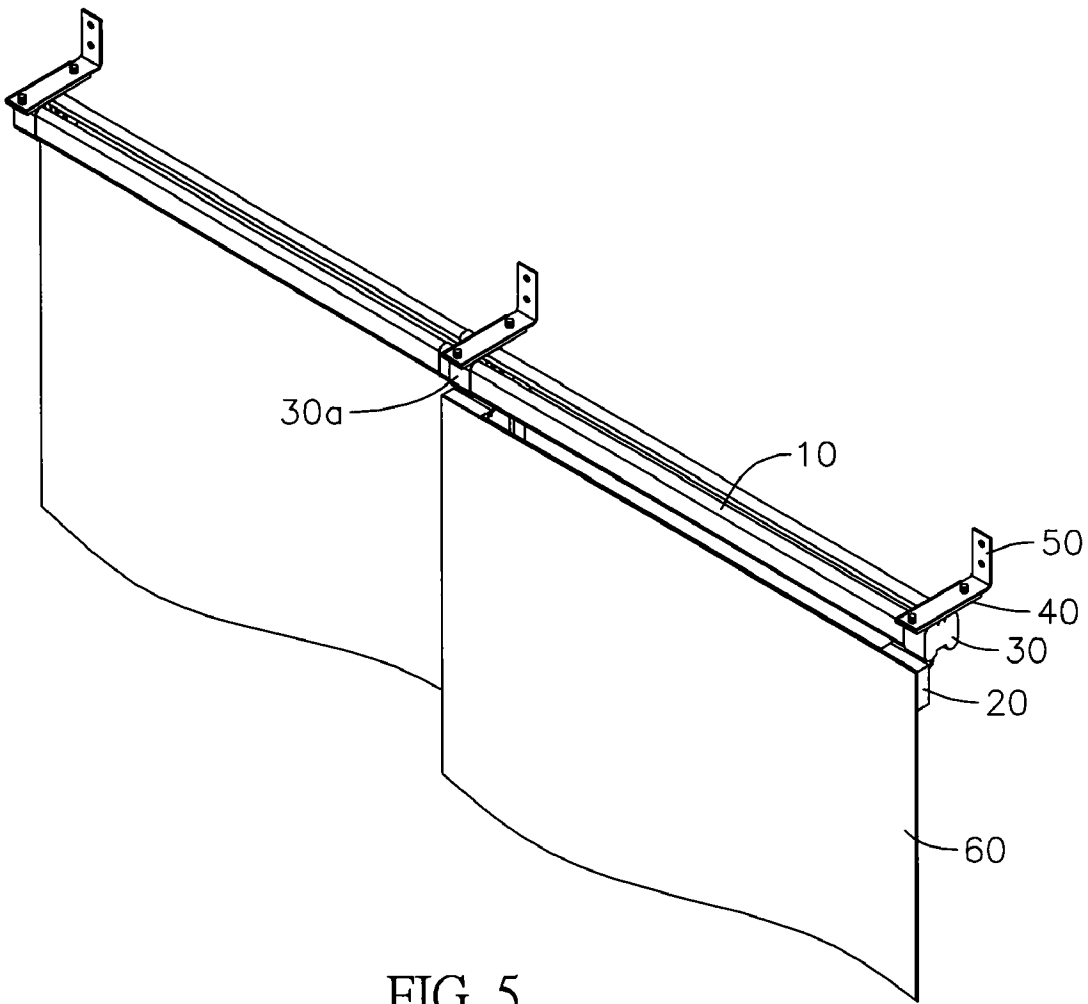
FIG. 5 shows a schematic view of a status of usage of a first embodiment of the present invention.

Referring to FIGS. 1 to 5, a slide rail structure for a window blind of the present invention comprises at least one extensible rail set 10, at least one pulley set 20, and a plurality of top brackets 30*a*.

The extensible rail set 10 is provided with at least slide rails 11 two rails which are assembled together an can be loosely extended with respect to each other, an interior of each of the slide rails 11 is formed with a holding space, and one side of each of the slide rails 11 is provided with an open slot 111.

The pulley set 20 is loosely assembled in the holding space in the slide rail 11 of extensible rail set 10, is extended out of the open slot 111 at one side of each slide rail 11, and is assembled with a long piece 21 on which is fixed with an assembly member (an adhesive strip 22) for assembling and positioning a window blind 60 which is correspondingly provided with an assembly member (an adhesive strip). The pulley set 20 is provided with two corresponding sliding blocks 23, a top of each of which is formed with a bended extension section 231. The bended extension section 231 is provided with a shaft 232, and a part of the bended extension section 231 in a neighborhood of the shaft 232 is formed with an arc part 230, whereas the shaft 232 is loosely assembled with a roller 233, an interior of which is provided with a ball bearing 234 (the shaft can be also directly and loosely assembled with a roller), enabling each slide rail 11 of the extensible rail set 10 to smoothly slide and forming a limitation to a sliding position. At least one side of the sliding block 23 is formed with a U-shape bending part 235, a side wall of the sliding block 23 is provided with a projection part 236 which may also be a means of attachment such as rivets, and each of two ends of the long piece 21 which is assembled with the pulley set 20 is provided with a through-hole 211 for locking the projection part 236 on the side wall of sliding block 23 with the through-hole 211 of long piece 21. On the other hand, a front end of the projection part 236 on the side wall of sliding block 23 is formed with a slope 237, to facilitate the long piece 21 to be pushed in for assembling (the long piece 21 having the adhesive strip 22 can be also directly pivoted on each sliding block 23 of the pulley set 20 or may also be attached by means of rivets).

Each top bracket 30*a* is assembled with the extensible rail set 10, and a side edge (single side or two sides) of the top bracket 30*a* is formed with an arc-shape locking part 31 to sheathe the slide rail 11 of extensible rail set 10 (an end side of the top bracket 30 assembled at two ends of the extensible rail set 10 can be further provided with a wall 32 for abutting and positioning the slide rail 11 of extensible rail set 10, whereas a position above the end wall 32 of top bracket 30 is provided with an indentation part 321 for improving strength of the top bracket 30; although the top bracket 30 shown in the drawings is provided with the wall 32, in a practical implementation, the top bracket 30 which is not provided with the wall 32 can be also used). In addition, each top bracket 30, 30*a* is provided with a hole 33 for locking and positioning, and a top of each top bracket 30, 30*a* can be further installed with an auxiliary piece 40 which is provided with a plurality of holes 41, to provide a mutual locking and assembling with the top bracket 30, 30*a* by screw elements 42 (a top of the top bracket 30, 30*a* can be further directly installed with a wall bracket 50 which is in a bended shape, with each of two ends of the bending part being provided with at least one hole 51 to provide a mutual locking and assembling with the top bracket 30, 30*a* by screw elements), whereas the auxiliary piece 40 can be further provided with a wall bracket 50 which is in a bended shape, and with each of two ends of the bending part being provided with at least one hole 51, such that the auxiliary piece 40 can be locked and assembled with the wall bracket 50 by screw elements 52. Furthermore, two sides above the auxiliary piece 40 are formed with bended projection parts 401 for positioning the wall bracket 50.

Figure 6:
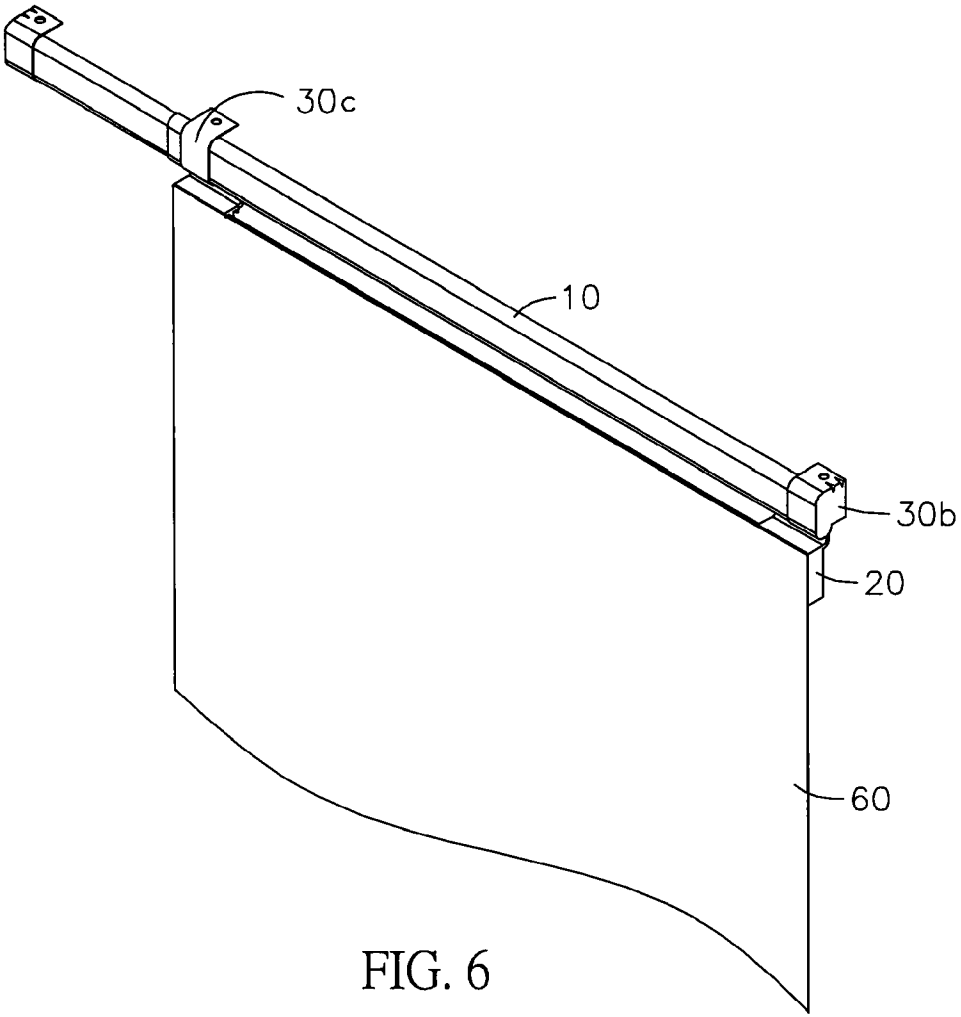
FIG. 6 shows a schematic view of a status of usage of a second embodiment of the present invention.
Figure 7:
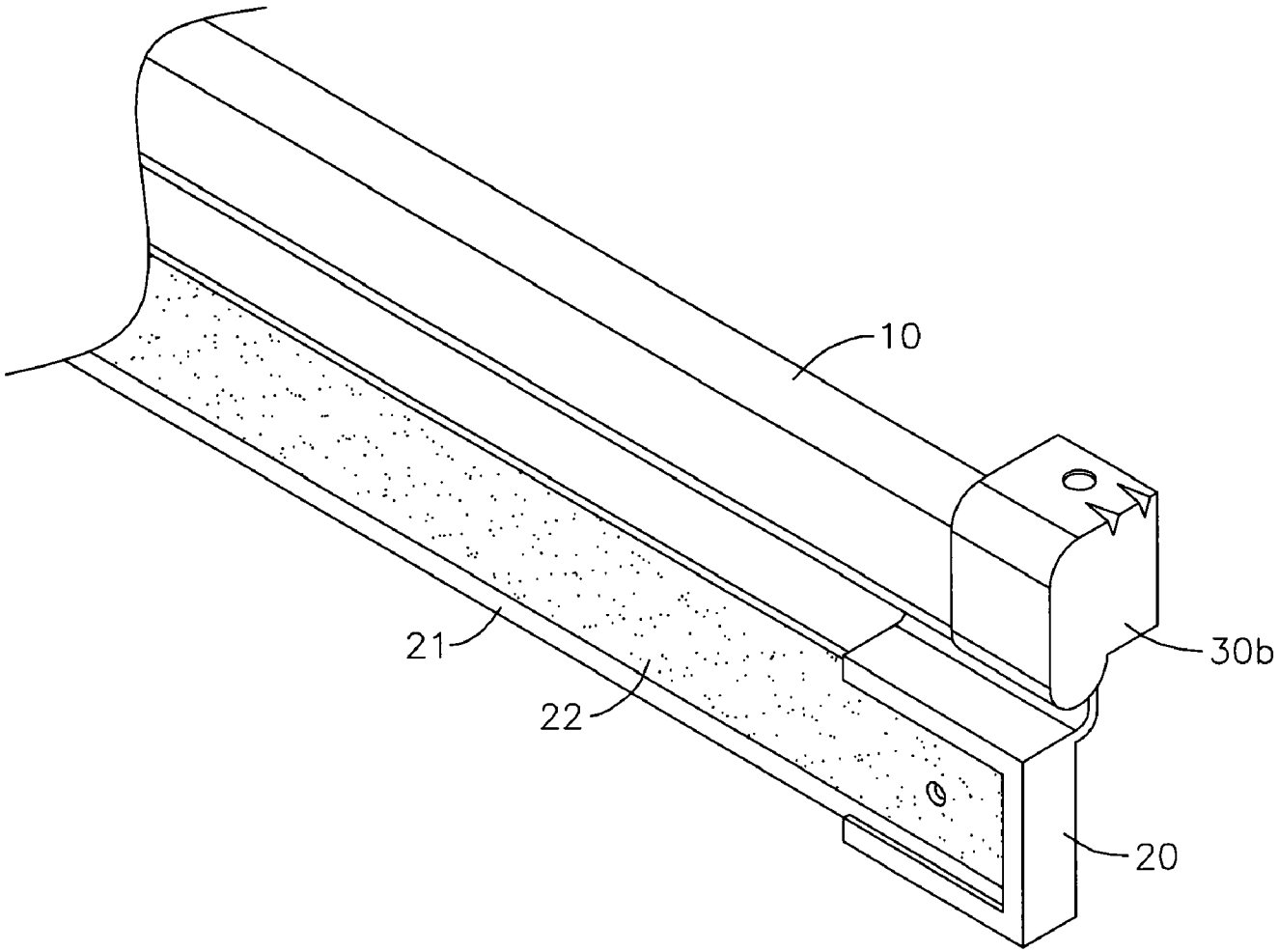
FIG. 7 shows an exploded view of a second embodiment of the present invention.
Figure 8:
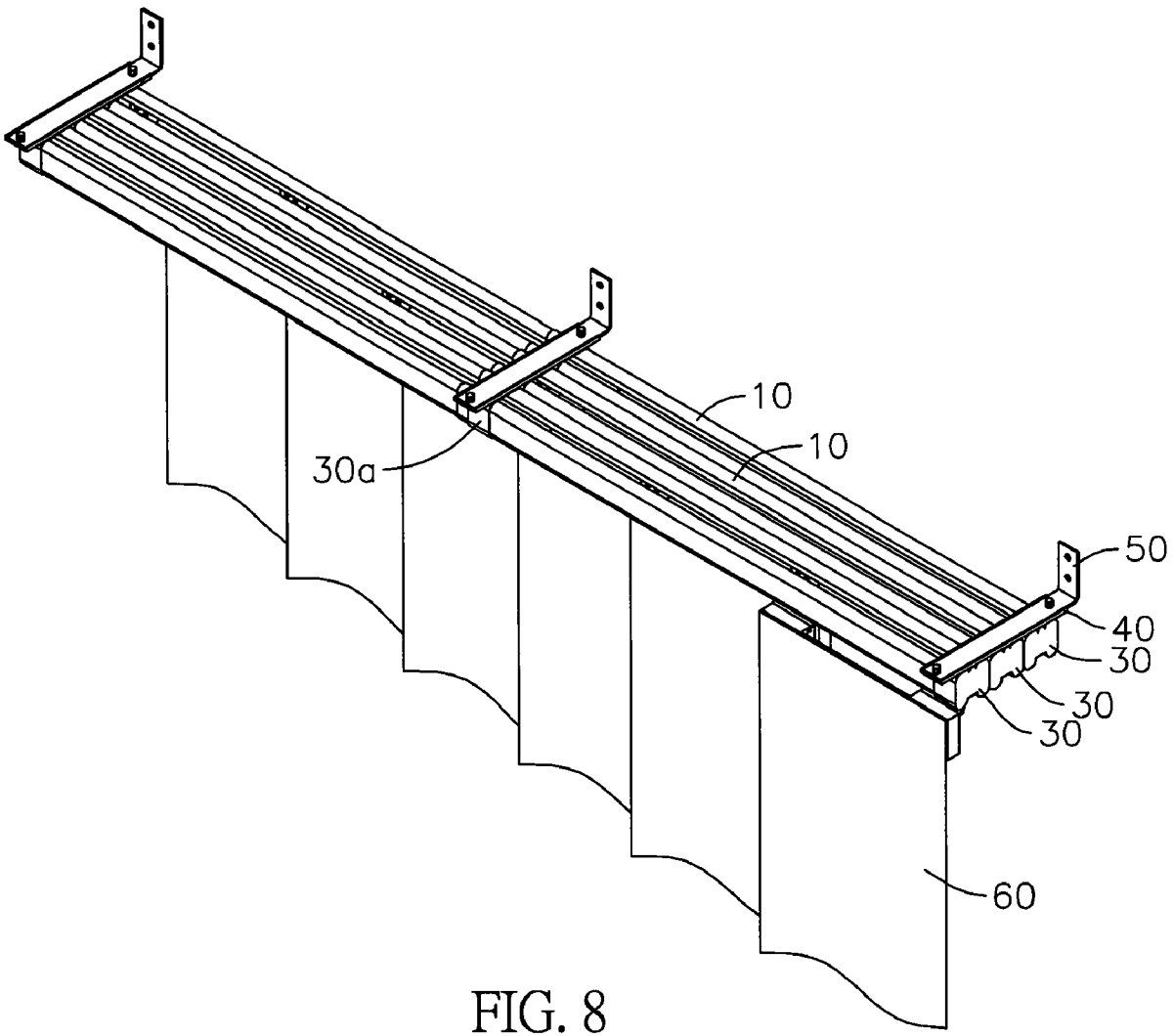
FIG. 8 shows a schematic view of a status of usage of a third embodiment of the present invention.
Figure 9:
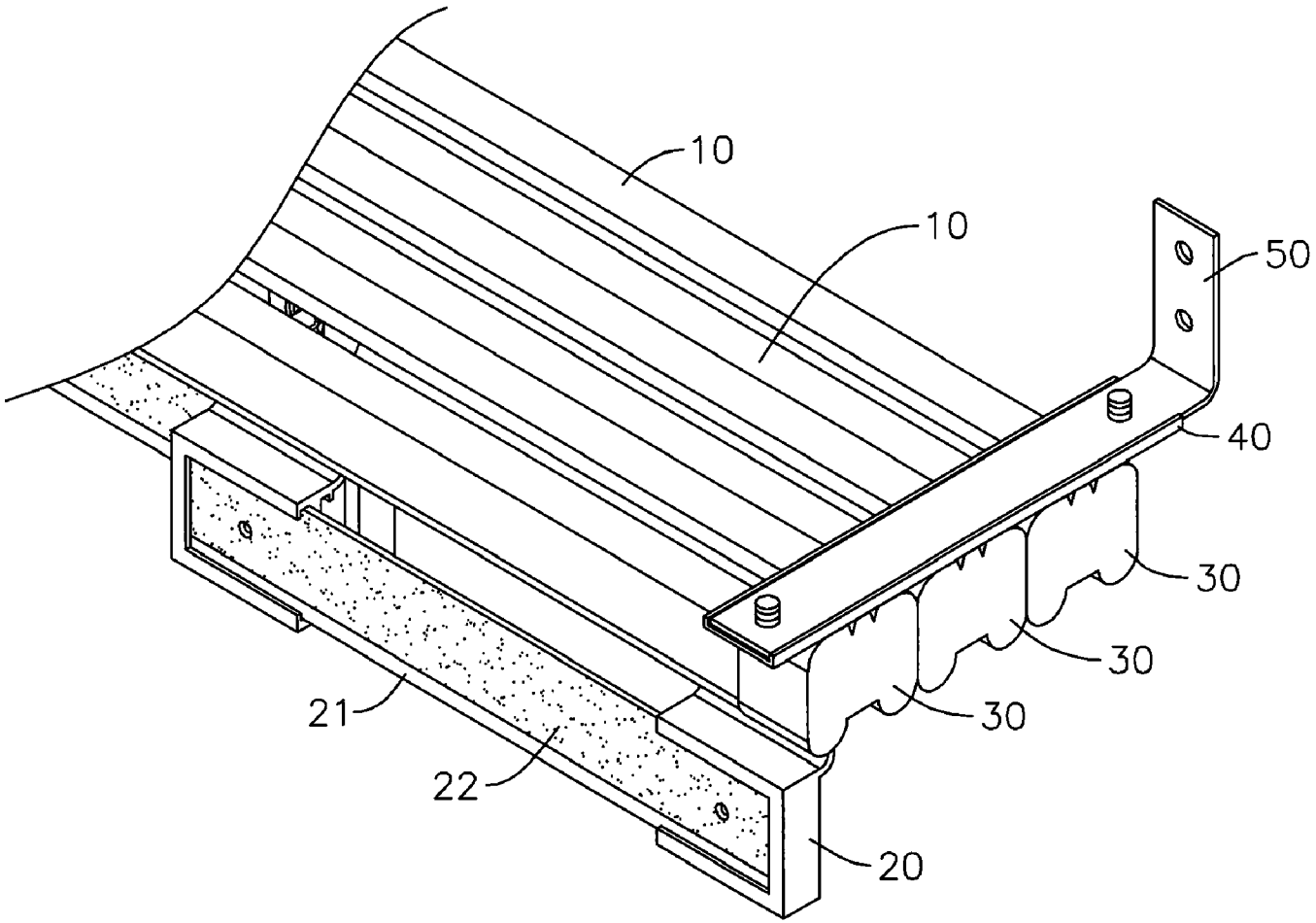
FIG. 9 shows an exploded view of a third embodiment of the present invention.

Referring to FIGS. 1 to 9, a slide rail structure for a window blind is constructed by the aforementioned structures, wherein by a design which assembles at least one extensible rail set 10, at least one pulley set 20, and a plurality of top brackets 30, 30*a*, each top bracket 30, 30*a* can provide a quick and robust sheathing for the slide rail 11 of extensible rail set 10 by the arc-shape locking part 31 at the side of top bracket 30, 30*a*. Whereas by the wall 32 which is formed at the end side of top bracket 30 for providing the abutting and positioning for the slide rail 11 of extensible rail set 10, cost and assembly time which were spent for manufacturing the top bracket and side cover at a same time can be effectively reduced, and, the indentation part 321 above the wall 32 at the end side of top bracket 30 can facilitate an improvement of strength of the top bracket 30. On the other hand, through the hole 33 on each top bracket 30, 30*a*, the top brackets 30, 30*a* can be directly locked and positioned on a ceiling, or, the hole 33 of each top bracket 30, 30*a* can be first locked and assembled with the plurality of holes 41 on the auxiliary piece 40 by the screw elements 42, and then the auxiliary piece 40 is assembled with the wall bracket 50 by the screw elements 52 according to requirement, such that the top brackets 30, 30*a* can be assembled on the wall surface or the ceiling. Therefore, each extensible rail set 10, pulley set 20, top bracket 30, 30*a*, and auxiliary piece 40 (the auxiliary piece 40 may not be used) are assembled first, and then are quickly locked on the wall bracket 50 by the implementation personnel, thereby facilitating the on-site implementation. In addition, the wall bracket 50 can be positioned between the bended projection parts 401 formed at two sides above the auxiliary piece 40, without being deflected. Moreover, through the long piece 21 between the two opposite sliding blocks 23 of the pulley set 20, the loose assembling of shafts 232 on the bended extension sections 231 of the sliding blocks 23 with the rollers 233 having the ball bearings 234 (or the direct loose assembling of the shafts with the rollers), and the projected arc parts 230 formed by the bended extension sections 231 in the neighborhood of shafts 23, each slide rail 11 can smoothly slide in the extensible rail set 10, and the limitation to the sliding position can be formed. Through the U-shape bending part 235 formed on at least one side of the sliding block 23, and the projection part 236 of slope 237 formed at the front end of side wall of the sliding block 23, the long piece 21 can be easily pushed in, and the sliding block 23 can be easily locked and assembled with the through-hole 211 of long piece 21, so as to form the rigid positioning. As the open slot 111 of each slide rail 11 of present invention is opened toward the interior, the entire appearance will be very delicate and pretty after being assembled, without exposing out the interior components, so as to increase the beauty. Therefore, the present invention is provided with the effects of an easy and quick assembling, a rigid positioning, a smooth sliding, and being delicate and pretty, thereby increasing a practicability, a convenience, and a beauty of the entire structure.

Referring to FIGS. 1 to 9, except to be applied to a dual-rail slide rail structure for a window blind, the present invention can be also applied to a single-rail or a multi-rail slide rail structure for a window blind. The multi-rail slide rail structure for a window blind is similarly provided with at least one extensible rail set 10, at least one pulley set 20, a plurality of top brackets 30, 30*a*, an auxiliary piece 40, a wall bracket 50, and a window blind 60, which are assembled according to requirement, such that the top brackets 30, 30*a* are close to each other, thereby effectively reducing an entire space of utilization. As the application is the same as that for the dual-rail slide rail structure, a further description is not needed. As for the single-rail slide rail structure, the aforementioned top brackets 30, 30*a* can be installed in a half, to form another single-rail top bracket 30*b*, 30*c* for sheathing the extensible rail set 10, wherein a side of the top bracket 30*c* is formed with an arc-shape locking part for sheathing the slide rail 11 of extensible rail set 10, and the top bracket 30*c* is provided with a hole for locking and positioning.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A slide rail structure for a window blind comprising at least one extensible rail set which is provided with at least two slide rails that are loosely extended with respect to each other and are assembled together, with each slide rail being formed with a holding space, and a side of each slide rail being provided with an open slot; at least one pulley set which is loosely assembled in the holding space in the slide rail of extensible rail set, is extended out of the open slot at one side of each slide rail, and is assembled with a long piece on which is fixed with an assembly member for assembling and positioning; and a plurality of top brackets, each of which is assembled with the extensible rail set, and a side of which is formed with an arc-shape locking part for sheathing the slide rail of extensible rail set, and which is provided with a hole for locking and positioning.

2. The slide rail structure for a window blind according to claim 1, wherein the pulley set is provided With two opposite sliding blocks, with a top part of each sliding block being formed with a bended extension section on which is provided with a shaft being loosely assembled with a roller, enabling each slide rail to smoothly slide in the extensible rail set.

3. The slide rail structure for a window blind according to claim 2, wherein at least one side of the sliding block is formed with a U-shape bending part, a side wall of the sliding block is provided with a projection part, and two ends of the long piece which is assembled with the pulley set are each provided with a through-hole, allowing the projection part on the side wall of sliding block to be locked and assembled with the through-hole of long piece.

4. The slide rail structure for a window blind according to claim 3, wherein a front end of the projection part on the side wall of sliding block is formed with a slope to facilitate the long piece to be pushed in for assembling.

5. The slide rail structure for a window blind according to claim 1, wherein a top part of the top bracket is further provided with an auxiliary piece which is installed with a plurality of holes, allowing the auxiliary piece to be locked and assembled with the top bracket by screw elements.

6. The slide rail structure for a window blind according to claim 5, wherein the auxiliary piece is further provided with a wall bracket which is formed into a bended shape, and two ends of the bending part are each provided with at least one hole, for locking and assembling with the auxiliary piece by screw elements.

7. The slide rail structure for a window blind according to claim 6, wherein two sides on a top of the auxiliary piece are formed with bended projection parts for positioning the wall bracket.

8. The slide rail structure for a window blind according to claim 1, wherein a single side of the top bracket is formed with an arc-shape locking part.

9. The slide rail structure for a window blind according to claim 1, wherein two sides of the top bracket are formed with arc-shape locking parts.

10. The slide rail structure for a window blind according to claim 2, wherein the assembly element is an adhesive strip, and the long piece which is provided with an adhesive strip is directly fixed on each sliding block of the pulley set by rivets.

11. The slide rail structure for a window blind according to claim 1, wherein a top of the top bracket is further provided with a wall bracket which is in a bended shape and two ends of the bending part are each provided with at least one hole, for locking and assembling with the top bracket by screw elements.

12. The slide rail structure for a window blind according to claim 2, wherein a projected arc part is formed on the bended extension section of sliding block, at a location in a neighborhood of the shaft, to allow each slide rail to smoothly slide in the extensible rail set, and to form a limitation of sliding position.

13. The slide rail structure for a window blind according to claim 1, wherein an end side of the top bracket assembled at each of two ends of the extensible rail set is further provided with a wall surface, for abutting and positioning the slide rail of extensible rail set.

14. The slide rail structure for a window blind according to claim 13, wherein a top of the wall surface at the end side of top bracket is provided with an indentation part, to improve strength of the top bracket.

* * * * *